US005597004A

United States Patent [19]

Okuda

[11] Patent Number: 5,597,004

[45] **Date of Patent: *Jan. 28, 1997**

[54] WINDPROOF UMBRELLA

[76] Inventor: Yukihiro Okuda, 4-3, 1-Chome Sugi, Hirakata City, Osaka, Japan

[ * ] Notice: The term of this patent shall not extend beyond the expiration date of Pat. No. 5,435,331.

[21] Appl. No.: 570,931

[22] Filed: Dec. 12, 1995

[51] Int. Cl.[6] ..... A45B 25/00

[52] U.S. Cl. ..... 135/29; 135/31

[58] Field of Search ..... 135/29, 31, 25.31, 135/25.3, 25.32

[56] References Cited

U.S. PATENT DOCUMENTS

| | | | |
|---|---|---|---|
| 4,007,752 | 2/1977 | Weber | 135/29 X |
| 4,884,586 | 12/1989 | Szu et al. | 135/29 X |
| 5,235,998 | 8/1993 | Liu | 135/29 X |
| 5,323,801 | 6/1994 | Kuo | 135/29 |
| 5,435,331 | 7/1995 | Okuda | 135/29 |

*Primary Examiner*—Lanna Mai
*Attorney, Agent, or Firm*—Bacon & Thomas

[57] ABSTRACT

A Windproof umbrella comprising strut, stay, tension member, joint and spoke forming a five member-rib structure, the improvement resides in each strut being formed of a round resilient material; the inner and outer ends of each tension member being bent downwardly to form loops; each joint member having a common axis for pivotally connecting both the outer end of the tension member and the inner end of the spoke and providing with a continued curved portion extending inwardly from the common axis; so that when the umbrella frame is turned inside out the tension members are curved downwardly by virtue of the exended portion of the joint member under tension for urging the joint members upwardly when the slider is pulled downwardly on the shaft, thereby restoring the umbrella to its originally closed condition.

1 Claim, 3 Drawing Sheets

WINDPROOF UMBRELLA

This invention relates to a windproof umbrella which can be automatically restored to its normally closed condition after its cover turned over by a gust of wind from underneath, by simply operating the slider downwardly along the shaft as in the fashion of closing the normally opened umbrella into closed condition.

The windproof umbrella of the afore said type has been proposed by the present inventor in U.S. Pat. No. 5,435,331 which is characterized by providing a tension member whose ends being upwardly bent into loop and pivotally connected to a joint member and a stay, respectively. Said tension member, when the umbrella is turned inside out by a gust of wind, will automatically bend downwardly and store a considerable energy which urges the joint member move upwardly when the slider moves downward along the shaft during the operation of the restoration of the umbrella.

In the umbrella of the prior patent, the inventor employs as in the conventional umbrella of the type, a strut having a U-shaped cross-section for assuredly receiving, within it's groove, the substantial part of the tension member when it is downwardly bent to thereby prevent the undesirable displacement of the same as well as the joint member.

The struts of the type recited above, in substance, do not constitute adverse effects on the restoration operation of the umbrella from its turned over condition to its normally closed condition. However, the struts are much stiffer as compared with spokes, by virture of their configuration and the material of which they are made. Thus, when the umbrella, particularly its cover, is subjected to a gust of wind and is turned inside out, the struts which are lack of resiliency, would be unduly bent or curved, and as a consequence, liable to result in the fatigue of the struts to such an extent that they might fail to bounce back to their original straight condition when such actions are repeated.

Once, the deformation of the struts occurs, the struts will fail to closely cluster around the shaft when the umbrella is disposed in its closed or collapsed condition and moreover, will damage the appearance of the umbrella in the open condition. In this connection, it is desirable to allow the struts to have resiliency so as to avoid the occurance of the above mentioned deficiency encountered in the U-shaped struts.

Further, in the prior patent, as set forth above, the inventor utilizes in the umbrella a resilient tension member with both ends thereof being upwardly bent loops to permit it automatically curving downwardly when the umbrella is inverted by strong wind.

The tension member with both ends thereof being downwardly bent loops, as opposed to the above mentioned one, has been proposed. However, such tension member curves toward the cover side when the umbrella is turned inside out by a gust of wind from underneath and is liable to get too much curved toward the cover side when the slider is pulled downward, which hinders the smooth closing of the umbrella.

As described above, whether the tension member as in my prior patent curves toward the side remote from the cover or, on the contrary, the tension member curves toward the cover side, both arrangements are capable to equally attain the purpose of restoring the inverted umbrella to its normally closed condition by simply operating the slider.

However, should it be possible to overcome the shortcoming of the tension member with downwardly bent loops as set forth above, such arrangement would be more optimal than that of my prior patent in effecting the restortion of the umbrella from its inverted condition to its normally closed condition. Because the curvature of such tension member, when forced to curve downwardly, is smaller than that of my prior patent, which means the energy stored in the former arrangement for urging the joint member is greater, and as a consequence allowing the joint member to more effectively act on the spoke connected to the outer end thereof to turn toward inner side and convert the inverted umbrella to its normally closed condition.

The measure to be taken in implementing such optimal effect in accordance with the present invention is to force the tension member to curve toward the side remote from the cover.

To achieve the above stated purpose and other improved merits, the present invention provides a windproof type umbrella comprising a shaft, a crown, a slider movably supported on the shaft and a collapsible frame secured to the crown and slider, wherein the frame includes a plurality of struts, a plurality of stays, a plurality of tension members, a plurality of joint members and plurality of spokes, with each strut having an inner end pivotally secured to the slider and an outer end pivotally secured to an outer end of a joint member, each stay having an inner end pivotally secured to the crown and an outer end pivotally secured to a strut at an intermediate position, each tension member having an inner end pivotally secured to a stay at an intermediate position and an outer end pivotally secured to an inner end of a joint member and a spoke secured to and extending outwardly from each joint member, the improvement comprising each strut being formed of a round resilient material; the inner and outer ends of each tension member being bent downwardly to form loops; each joint member having a common axis for pivotally connecting both the outer end of the tension member and the inner end of the spoke and providing with a continued curved portion extending inwardly from the common axis; so that when the umbrella frame is turned inside out, the tension members are curved downwardly by virtue of the exended portion of the joint member under tension for urging the joint members upwardly when the slider is pulled downwardly on the shaft, thereby restoring the umbrella to its originally closed condition.

The present invention will now be described with reference to the accompanying drawings in which.

Figure 1B:
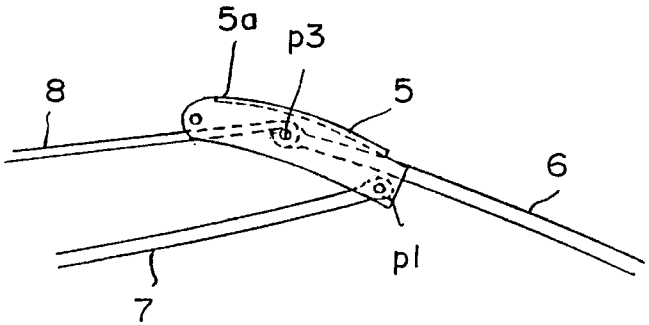
FIG. 1A is a partial front view of the umbrella in open condition, showing the improved portion of the invention with an enlarged view of the encircled portion (FIG. 1B)
Figure 1A:
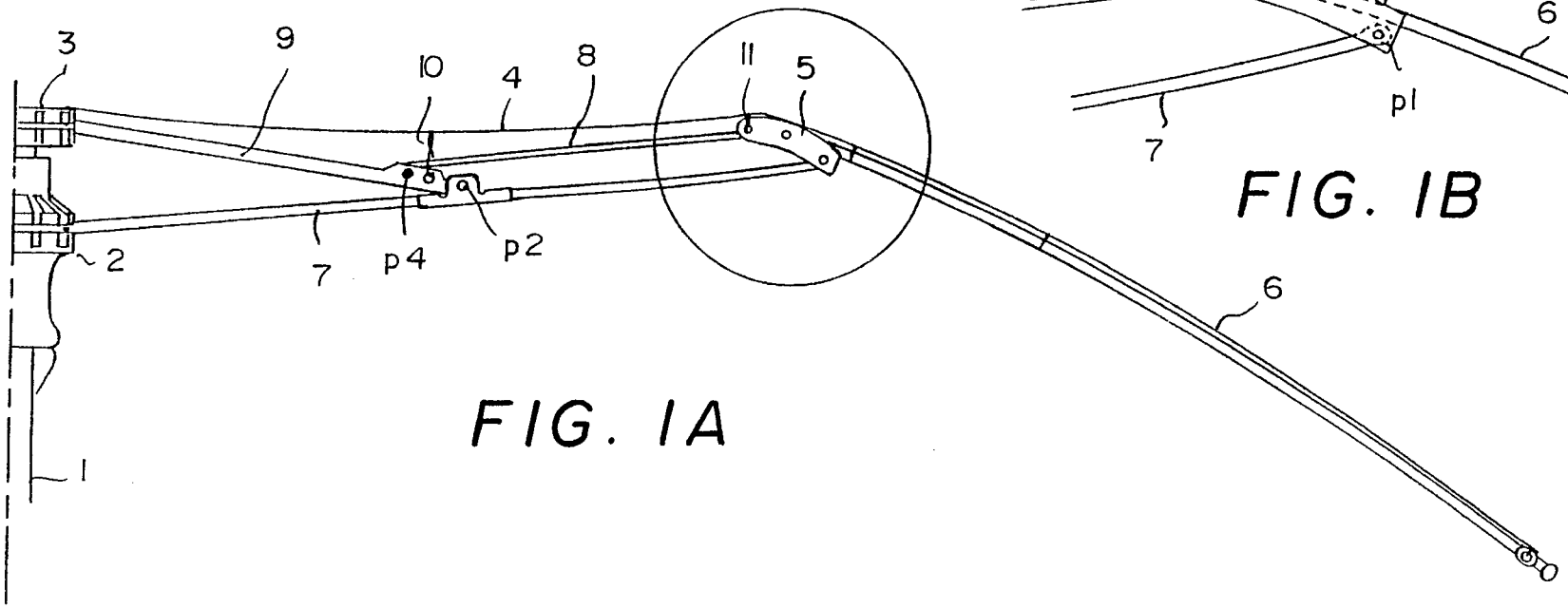

As shown in FIG. 1A, the umbrella according to the invention has in known way a shaft 1, with a crown 3 secured to its upper end, a slider 2 slidably provided on the shaft, and frame consisting of struts 7, stays 9, tension members 8, joint members 5 and spokes 6. Pivoted to the slider 2 are struts 7 with their outer ends linked through joint member 5 to the spokes 6. The inner ends of the stays 9 are linked to the crown 3 and the outer ends are pivotally connected to the intermediate of the struts 7. The tension members 8 have their inner ends linked to the intermediate of the stays 9 at joint P4 and the outer ends linked to the intermediate portion of the joint member 5 at point P3 as clearly shown in FIG. 1B. Numerals 4 is the umbrella cover whilst 10 and 11 each represents a thread for securing the cover to the members shown in the drawings.

Figures 2A, 2B, 2C:
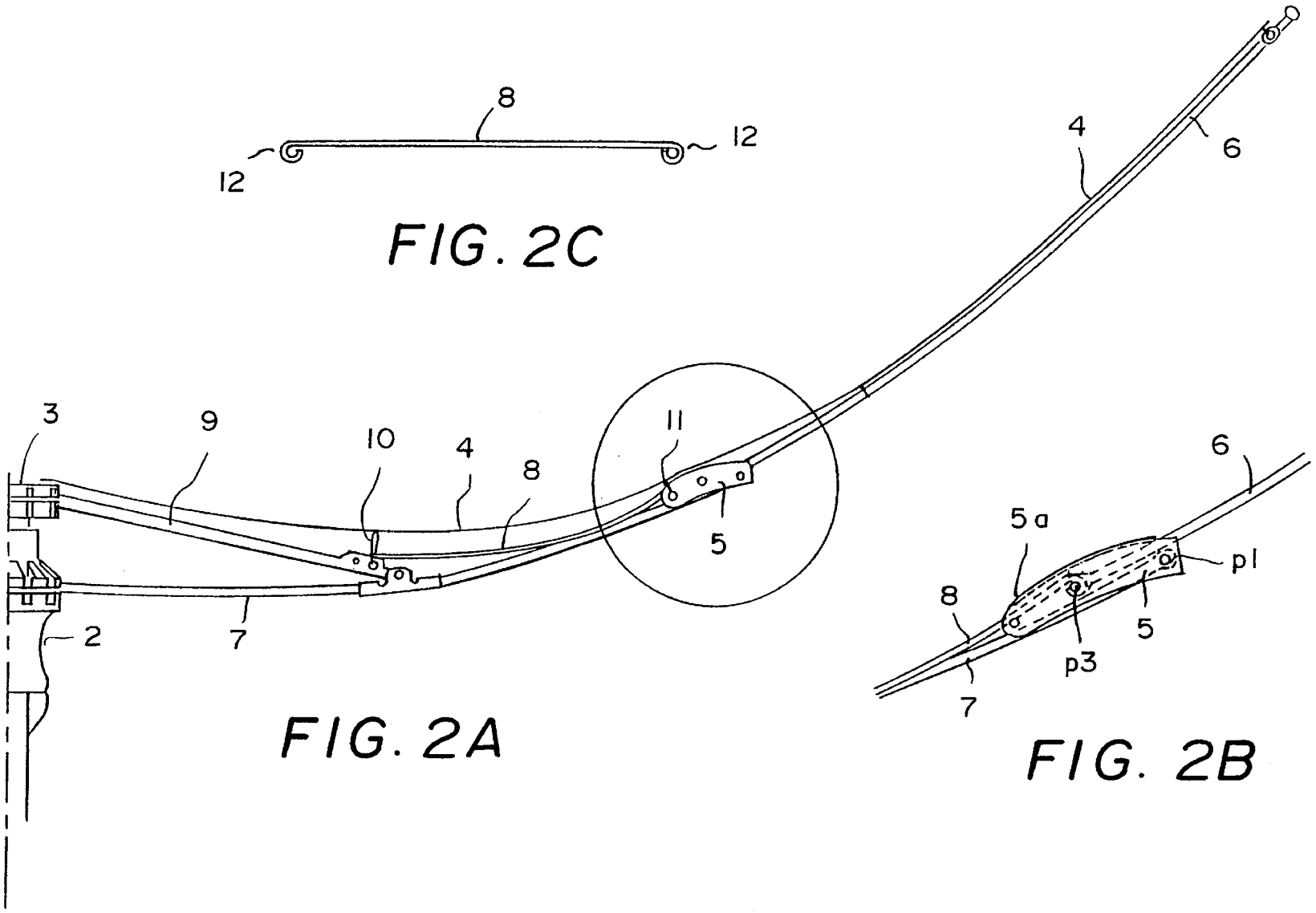
FIG. 2A is the turned over condition of the umbrella in partial view with an enlarged portion (FIG. 2B) and a tension member of the invention in front view (FIG. 2C)

The improvement provided by the invention firstly resides in the tension member 8 which is formed from a small sized resilient material, for instance, a straight steel wire having a diameter around 1 mm. The both ends of the tension member 8 are bent downwardly into loops 12 as shown in FIG. 2C and pivotally connected to the stay 9 and the joint member 5 with the pivotal axes extending through loops 12, respectively at point P4 and point P3. Thus, the axes at point P3 on the joint member 5 serve as a common pivotal axis for both the tension member 8 and the spoke 6.

The second improvement according to the invention resides in the struts 7 which are formed from the same material as the tension member except for the diameter. The diameter of the struts 7, though not critical, is preferably in the range of from 1.7 to 2.0 mm, so as to maintain a good balance with the other members consituting the frame.

The further improvement according to the invention resides in the joint member 5 which has a slightly curved upper portion and a continued downwardly curved portion 5*a* extending inwardly (left side on the drawing) from the point P3 which serves as a common pivotal axis for the tension member 8 and the spoke 6, as shown in FIG. 1B. In addition, the joint member 5 has at its outer lower portion a pivotal axes P1 for connecting the outer end of the strut 7. The tension member 8 and the joint member 5 have been so constructed in the aforesaid manner, thus when the umbrella is subjected to a gust of wind causing the umbrella to be turn over to take the position as represented in FIG. 2A, the tension member 8 will be forcedly pressed by the edge of the exended portion 5*a* of the joint member 5 and curved downwardly toward the strut 7 side.

Figure 3:
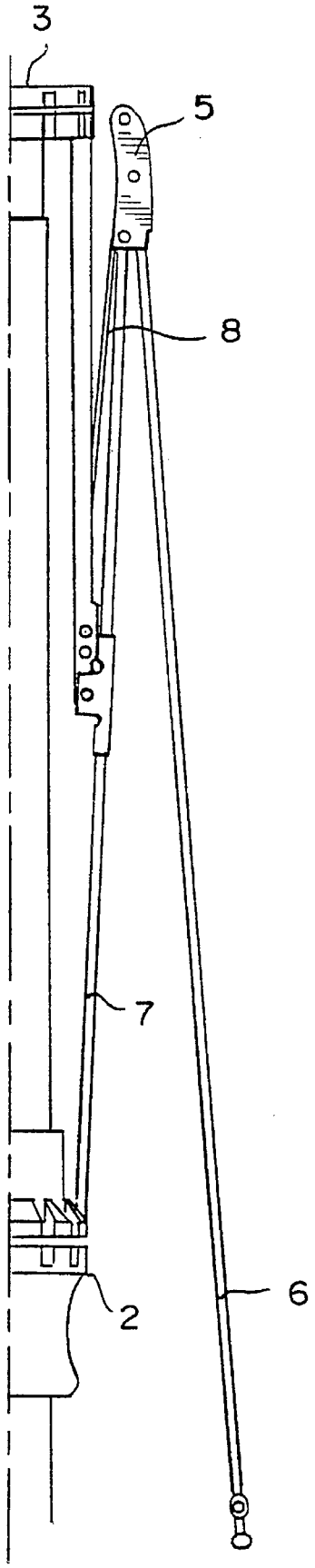
FIG. 3 is the closed ribs of frame of the umbrella of the invention in partial view.

In the operation of the umbrella from the inverted condition of FIG. 2A to the normally closed condition of FIG. 3, the slider is simply moved downward along the shaft 1 as in the manner of closing the normal umbrella from an open condition to a closed condition, so that the tension member 8 urges the joint member 5 to move upward. As the result of this movement, the spoke 6 moves gradually downward to restore the normal condition and finally resumes the closed condition as shown in FIG. 3.

The downwardly curved tension member 8 is in a considerably energized or tensioned state that it may actively function on the joint member 5 to effect the desired restoration operation.

The joint member 5 with the curved upper portion assists the frame to more closely cluster around the shaft 1 when the umbrella resumes its closed or collapsed position for storage.

What is claimed is:

1. In a windproof umbrella of the type having a shaft, a crown, a slider movably supported on the shaft and a collapsible frame secured to the crown and slider, wherein the frame includes a plurality of struts, a plurality of stays, a plurality of tension members, a plurality of joint members and plurality of spokes, with each strut having an inner end pivotally secured to the slider and an outer end pivotally secured to an outer end of a joint member, each stay having an inner end pivotally secured to the crown and an outer end pivotally secured to a strut at an intermediate position, each tension member having an inner end pivotally secured to a stay at an intermediate position, and an outer end pivotally secured to a middle position of a joint member and a spoke secured to and extending outwardly from each joint member, the improvement comprising each strut being formed of a round resilient material; the inner and outer ends of each tension member being bent downwardly to form loops; each joint member having a common axis for pivotally connecting both the outer end of the tension member and the inner end of the spoke and providing with a continued curved portion extending inwardly from the common axis; so that when the umbrella frame is turned inside out the tension members are curved downwardly by virtue of the exended portion of the joint member under tension for urging the joint members upwardly when the slider is pulled downwardly on the shaft, thereby restoring the umbrella to its originally closed condition.

* * * * *